US008955712B2

(12) United States Patent
Kloss et al.

(10) Patent No.: US 8,955,712 B2
(45) Date of Patent: Feb. 17, 2015

(54) CONTAINER HAVING A RELOCKABLE LID PROVIDED WITH A RESILIENT RING

(75) Inventors: Uwe Ernst Kloss, Seesen (DE); Manfred Hubert, Woltershausen (DE)

(73) Assignee: Ardagh MP Group Netherlands B.V., Deventer (NL)

( * ) Notice: Subject to any disclaimer, the term of this patent is extended or adjusted under 35 U.S.C. 154(b) by 277 days.

(21) Appl. No.: 13/514,709

(22) PCT Filed: Oct. 21, 2010

(86) PCT No.: PCT/EP2010/065878

§ 371 (c)(1), (2), (4) Date: Jun. 8, 2012

(87) PCT Pub. No.: WO2011/069734

PCT Pub. Date: Jun. 16, 2011

(65) Prior Publication Data

US 2012/0248130 A1 Oct. 4, 2012

(30) Foreign Application Priority Data

Dec. 8, 2009 (DE) ..... 20 2009 016 507 U

(51) Int. Cl.
*B65D 41/16* (2006.01)
*B65D 41/18* (2006.01)
(Continued)

(52) U.S. Cl.
CPC ..... *B65D 43/0212* (2013.01); *B44D 3/127* (2013.01); *B65D 45/02* (2013.01);
(Continued)

(58) Field of Classification Search
CPC ..... B65D 2543/00537; B65D 43/0212; B65D 43/0256; B65D 2543/00972
USPC ..... 220/794, 780, 648, 317, 324, 784, 236, 220/305, 649, 326, 319, 276; 215/317
See application file for complete search history.

(56) References Cited

U.S. PATENT DOCUMENTS 4,376,493 A * 3/1983 Gall ..... 220/784
4,465,205 A * 8/1984 Sutch ..... 220/276
(Continued)

FOREIGN PATENT DOCUMENTS

CH 624 356 A5 7/1981
DE 806 310 C 6/1951
(Continued)

OTHER PUBLICATIONS

International Search Report, dated Jan. 24, 2011, from corresponding PCT application.

*Primary Examiner* — Bryon Gehman
*Assistant Examiner* — Shawn M Braden
(74) *Attorney, Agent, or Firm* — Young & Thompson

(57) ABSTRACT

A container includes (i) a metal receiving body having a peripheral upper edge delimiting an upper opening and provided with an one-piece outwardly projection and (ii) a relockable lid including a metallic cover provided with a resilient ring having a locking part with a lower free edge, and divided into two annular portions separated by an annular folding line, whose lower portion is foldable around the folding line between two stable positions. The locking part has:—locking elements including a plurality of beads arranged around the inner surface of the lower portion and at a distance from each other, and—a plurality of orifices, arranged around the locking part at a distance from each other and extending at a distance from the lower free edge, wherein the orifices extend through the locking part, at least over a part of the height of the upper and lower portions thereof.

15 Claims, 2 Drawing Sheets

(51) Int. Cl.

| | |
|---|---|
| ***B65D 17/40*** | (2006.01) |
| ***B65D 43/02*** | (2006.01) |
| ***B44D 3/12*** | (2006.01) |
| ***B65D 45/02*** | (2006.01) |

(52) U.S. Cl.

CPC ..... *B65D2543/00092* (2013.01); *B65D 2543/0024* (2013.01); *B65D 2543/00277* (2013.01); *B65D 2543/00296* (2013.01); *B65D 2543/00509* (2013.01); *B65D 2543/00537* (2013.01); *B65D 2543/00555* (2013.01); *B65D 2543/00638* (2013.01); *B65D 2543/00685* (2013.01); *B65D 2543/00759* (2013.01); *B65D 2543/00805* (2013.01); *B65D 2543/00972* (2013.01)

USPC ..... 220/780; 220/794; 220/276

(56) References Cited

U.S. PATENT DOCUMENTS

| | | | | |
|---|---|---|---|---|
| 5,540,349 | A * | 7/1996 | Philips | 220/780 |
| 6,196,451 | B1 * | 3/2001 | Helms | 229/125.13 |
| 8,387,822 | B2 * | 3/2013 | Antal et al. | 220/786 |
| 2001/0010311 | A1 * | 8/2001 | Ciccone | 220/276 |
| 2005/0224499 | A1 * | 10/2005 | Jorgensen et al. | 220/315 |

FOREIGN PATENT DOCUMENTS

| | | | |
|---|---|---|---|
| FR | 2 801 873 | A1 | 6/2001 |
| WO | 01/44069 | A1 | 6/2001 |
| WO | 03/062081 | A1 | 7/2003 |
| WO | 2007/055651 | A1 | 5/2007 |

* cited by examiner

CONTAINER HAVING A RELOCKABLE LID PROVIDED WITH A RESILIENT RING

BACKGROUND OF THE INVENTION

Field of the Invention

The present invention relates to containers having a relockable lid, in particular for storage of liquid e. g. chemicals/solvents.

DESCRIPTION OF THE RELATED ART

Some chemicals or other liquids comprising solvents have to be stored in containers or cans (i.e. a lid and a receiving body) made of metal, so as to avoid leakage due to the solvent dissolving action on the material of the container.

However, opening of a full metal container is usually difficult; in most of the case, it requires a sharp-pointed article (e. g. a screwdriver) that can be stuck in between the body ant the lid, so as to lift the latter.

Furthermore, the closing of such container requires a relative high pressure on the lid in order to press it tightly onto the opening of the body.

It is also highly desired by consumers that a container of product, for example of paint, after its first opening, can be resealable with the container lid. This is particularly the case for cans of large capacities, as commonly all of the product in the container is not used at the one time. Thus the can needs to be resealed to preserve the remaining content for use at a later time.

From prior art, it is known to provide a relockable non-plastic lid for a container, which is easy to fit and refit without the need of any kind of tool. Such a reclosable lid is disclosed, for example, in documents WO-A-01/44069 or WO-A-03/062081.

In particular, the document WO-A-03/062081 describes a reclosable lid suitable for a receiving body having a sidewall terminated by a curl portion encircling an upper opening to be closed.

The said lid comprises a non-plastic part intended to cover at least said opening, and a non-metallic ring attached to the border of said cover.

The resilient ring comprises, first, a fastening part attached to peripheral border of the cover and, second, a locking part projecting downwardly; said ring locking part is divided into two annular portions separated by an annular folding line, i.e. an upper portion and a lower portion arranged above and bellow said folding line, respectively.

The lower portion comprises an inner surface provided with locking means to be engaged below said curl portion so as to lock said lid onto the receiving body; and said lower portion is foldable around said folding line between two stable positions: a locking position and an upper folded unlocking position.

However, the manual operation of such a resilient ring between its two positions is often not so easy, in particular due to its characteristics of rigidity.

Furthermore, in case of in-mould production process of such a metal cover/resilient ring combination, it leads normally to system induced tool-part-measurements which does not admit any mass-production.

Indeed, the metal cover/resilient ring combination requires a minimum core-depth or kernel-depth of the metal cover to keep of the stackability qualities of several lids one on the other. A minimum kernel-depth of the lid is also required to preserve the lid fitted onto the receiving body.

During the form-process of the ring, a form-kernel must be moved in between the cover-kernel and the area of the formative ring. After forming the ring, this form-kernel must be pulled vertically upward. However because the ring at its inside-profile shows a bead, this is not possible.

Moreover, due to the very low distance between the cover-kernel and the moulded ring none shared, individually sliding kernel-slice could not be used. These would lead to none sturdily tool parts. Necessary, demanded production-tolerances for the ring and a durability mass-production could not be realized on this basis.

There is thus a need for a relockable lid suitable for effectively sealing a container, which is readily manually removable from and also resealable onto a receiving body.

Preferably, this lid should also be simple to manufacture in mass-production and in particular by in-mould process.

BRIEF SUMMARY OF THE INVENTION

The present invention seeks to provide a container which meets these needs.

The container according to the invention is of the type disclosed in document WO-A-03/062081, i.e. comprising (i) a metal receiving body having a sidewall provided with, at a lower end, a bottom element, and at an upper end, a peripheral upper edge delimiting an upper opening and provided with an one-piece outwardly projection and (ii) a relockable lid comprising a metallic cover, suitable to close said body upper opening, whereof the peripheral border is provided with a resilient ring, wherein said resilient ring comprises, first, a fastening part fastened with said cover peripheral border and, second, a locking part projecting downwardly, wherein said ring locking part has a lower free edge and is divided into two annular portions separated by an annular folding line, i.e. an upper portion and a lower portion arranged above and bellow said folding line, respectively, wherein said lower portion comprises an inner surface provided with locking means to be engaged below said outward projection of the receiving body so as to lock said lid onto said receiving body, and wherein said lower portion is foldable around said folding line between two stable positions: a locking position and an upper folded unlocking position.

In accordance with the said invention, said locking part of the resilient ring is provided with:

- said locking means comprising a plurality of beads, arranged around the inner surface of said lower portion and at a distance from each other, according to a plan extending at a distance from said ring lower free edge, and
- a plurality of orifices, arranged around said locking part, at a distance from each other and extending at a distance from said ring lower free edge, wherein said orifices extend through said locking part, at least over a part of the height of said upper and lower portions thereof.

The term "ring" is to be understood as encompassing non-circular forms as well as circular ones. Thus the invention is intended to cover closures for containers (lid and receiving body) of circular, oval, hexagonal, square, rectangular or other polygonal cross-section.

The outward projection of the receiving body, at or adjacent its sidewall upper edge, may be an external curl, fold, roll, bead or the like, or any other radially outward formation which provides an under-surface or ledge on which the beads of the resilient ring can effectively engage and rest.

The invention provides a lid which is constructed of two components which are effectively permanently joined together. The two components are the metal cover and the resilient ring. Thus to a user, the lid is effectively a single item.

The resilient ring may be secured to the metal cover by press fitting, or it may be moulded onto the metal cover. The resilient ring may be attached and seamed to the metal cover so that the ring is seamed in between two oppositely arranged flanges, or it can be glued thereto, or it may be injection moulded to the cover, or it may be attached to the cover by a combination of any of these attachment methods. Alternatively, the ring may be clicked on to the cover. In that case the ring may either be fixed or detachable mounted to the cover.

The beads each include an upper surface which seats under the outward projection and thus holds the border of the metal cover in sealed engagement with the body upper edge.

The resilient ring may be made of rubber, which engages under the sidewall projection.

The resilient ring extends advantageously continuously along the entire circumference of the cover and the receiving body.

The shape of the resilient ring is the same as the container (e.g. cylindrical, oval, elliptical or polygonal).

Other advantageous and preferred characteristics of the invention, which can be taken in combination or independently, are specified here-under:

- the orifices and the beads are arranged by couple, said orifices being arranged directly above said beads such as the lower border of said orifices corresponds to the upper face of the associated beads, and wherein said couples are arranged at a distance from each other around the ring locking part; such an embodiment is particularly interesting in molding production process and preferably in-mould production process;
- the orifices extend, on the one hand, over the entire height of the upper portion of the ring locking part, and on the other hand, over a part of the height of the lower portion of the ring locking part;
- the upper portion of the ring locking part is of cylindrical shape, and the lower portion of the ring locking part is of frustum shape, extending outwardly from the top to the bottom;
- each bead has a tab shape, having an upper face arranged with an upwardly slope extending towards the metallic cover; in this case, each bead has preferably an upper face of flat shape, and a lower face of curved shape extending also upwardly;
- the lower face of each bead is provided with at least one rib extending radially, or at least approximately radially; in this case, the lower face of each bead is advantageously provided with at least two lateral ribs, at a distance from each other and extending radially, or at least approximately radially;
- the metallic cover comprises a peripheral border provided with a flange having (i) an inner part, intended to cover the upper peripheral edge of the body sidewall, and (ii) an outer part, intended to extend outwardly to said upper peripheral edge of sidewall and to be fastened with said ring fastening part;
- the orifices correspond together from 30% to 80% of the circumference of the ring locking part;
- the outward projection of the receiving body is of frustum shape, oriented downwardly and outwardly in the direction top to bottom of said body sidewall.

Furthermore, the cover may comprise a wall portion engageable with an internal surface of the body defined by its sidewall; said wall portion and the ring define a peripheral cavity or channel, open downwardly, for receiving said sidewall upper edge and its outward projection.

The wall portion may be outwardly inclined, so that said wall portion and the internal surface of the body sidewall may be frictionally engage each other and as a result that the lid is maintained in its position in the opening of the receiving body even if the resilient ring is not in its locking position.

In another embodiment, the cover may comprise a plane cover surface extending substantially perpendicular to the sidewall of the body and without extending into the body, so that the above-mentioned wall portion may be dispensed with. In that case the lid may be locked to the body by means of the resilient ring only.

In order to provide a tight closure for the container, a compound (a material for providing a sealed/tight closure) may be placed between the cover and the receiving body. The compound may be e. g. a rubber band or a band of silicone sprayed on or an elastomer or a soft polymer or a synthetic rubber composite.

The compound may be placed between the sidewall of the receiving body and the peripheral wall portion of the cover, such as inside a corrugation in the sidewall of the body or the wall portion.

The present invention relates also to a process for the manufacture of a relockable lid as specified above, wherein the resilient ring is formed in situ on the metal cover by moulding, and wherein the beads are generated through moulding tool parts which are sliding from outside and in direction of the centre of the tool, said tool parts closing the kernel area till the core of the metal cover, and forming both the upper surface of the beads and the orifices.

BRIEF DESCRIPTION OF THE DRAWINGS

The invention is also disclosed, without any limitation, by the following specification of a particular embodiment, in accordance with the enclosed drawings wherein.

DETAILED DESCRIPTION OF THE PREFERRED EMBODIMENTS

Figure 1:
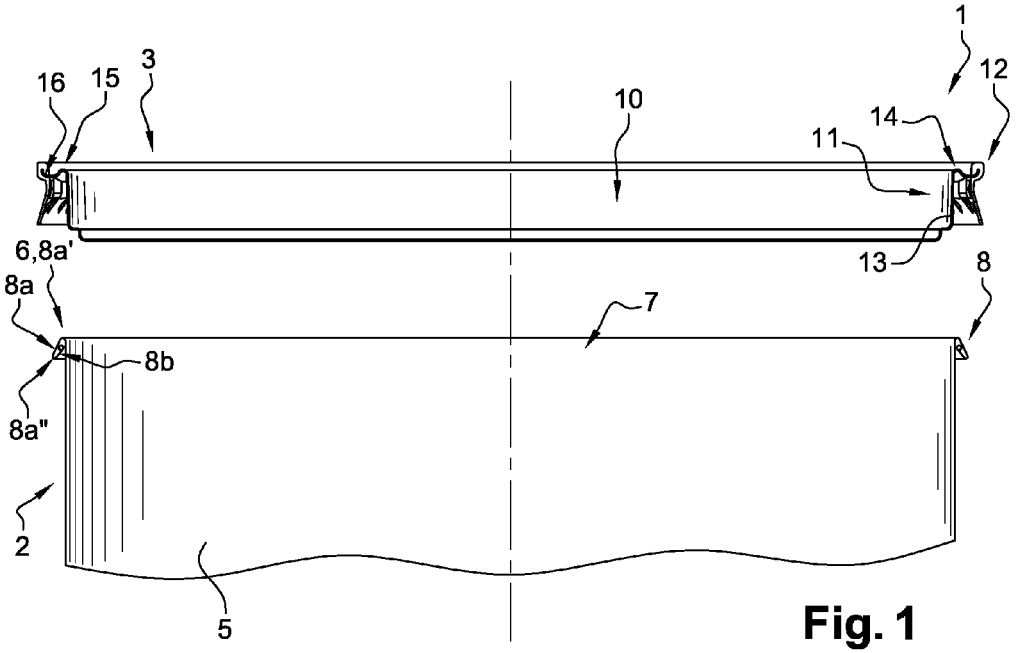
FIG. 1 shows, in cross section, a container according to the invention wherein the relockable lid is arranged just above a receiving body whereof only its upper part is shown.

The container 1, as shown FIG. 1, comprises (i) a receiving body 2, made out of metal, and (ii) a lid 3 of relockable type (also named as lid of "reclosable type").

The receiving body 2 is here of cylindrical-shape; it is of can-type or pail-type.

This receiving body 2 comprises a sidewall 5 (whereof only upper portion is here illustrated) having, at a lower end, a bottom element (not shown), and at an upper end, a peripheral edge 6 delimiting an upper opening 7.

The sidewall 5 of the receiving body 2 is provided with an one-piece outwardly projection 8, here formed by a curl terminating said upper edge 6 of sidewall 5. Such a terminal curl 8 is obtained by any suitable metalworking process, e.g. bending.

The outward projection 8 is here, and without any limitation, provided with a cross-sectional of triangle shape.

It thus comprises in particular an inclined portion 8*a* of frustum-shape, oriented downwardly and outwardly in the direction top to bottom of the sidewall 5. Said inclined portion 8*a* has (i) an upper end 8*a*', corresponding also to the sidewall upper edge 6, and (ii) a lower end 8*a*", lengthened by an upwardly portion 8*b* also of frustum-shape which extends between said inclined portion 8*a* and the facing sidewall 5.

Alternatively, said outward projection 8 of the receiving body 2 can be e.g. of square shape or any other suitable shape.

The outward projection 8 extends continuously along the entire circumference of the sidewall upper edge 6.

But as an alternative, said outward projection 8 may consist of two or three or four or more individual projections or lengths of projection, detached one from the other by angular sectors.

Figure 6:
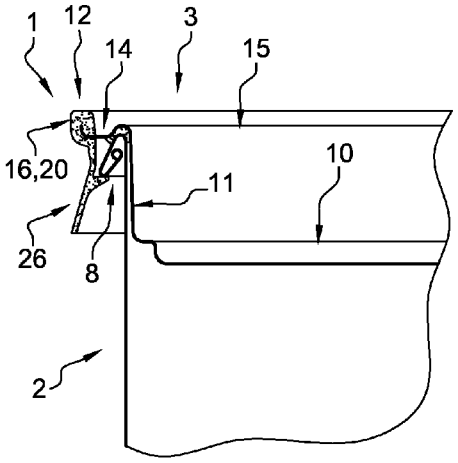
Figure 7:
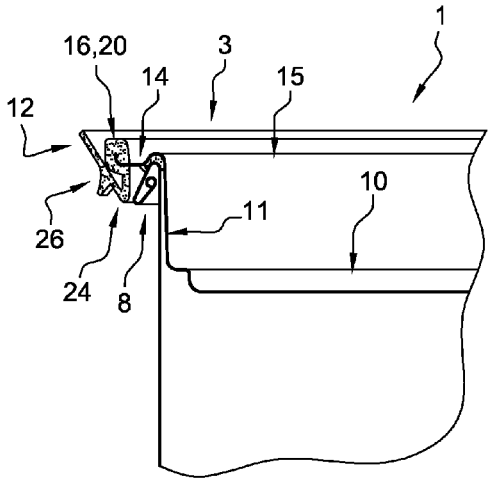

On the other hand, as shown also FIGS. 1, 6 and 7, the relockable lid 3 comprises a metal cover 10, suitable to close the upper opening 7 of the receiving body 2, whereof the peripheral border 11 is provided with a resilient ring 12 (also named as "plastic ring" or "plastic skirt" or "resilient skirt") intended to cooperate with the outward projection 8 of the receiving body 2.

The metal cover 10 comprises a central wall portion, here of flat shape, whereof the peripheral border 11 comprises an upward wall portion 13, of cylindrical shape, which is suitable to engage with an upper part of the internal surface of the sidewall 5 of receiving body 2. Said wall portion 13 is prolonged at its upper end by an outward flange 14.

The outward flange 14 comprises here—an inner part 15, curved to define a downwardly open channel intended to rest onto the sidewall upper edge 6, and—an outer part 16, shaped to receive here the resilient ring 12 by injection moulding.

The inner part 15 of the outward flange 14 is here provided with a sealing compound, fitting tightly to the upper edge 6 of the sidewall 2 of the receiving body 2, so as to provide a sealed closure.

As above-mentioned, the resilient ring 12 is secured and fastened to the peripheral border 11 of the metal cover 10, by any suitable manner chosen notably in function of the manufacture process.

Figure 2:
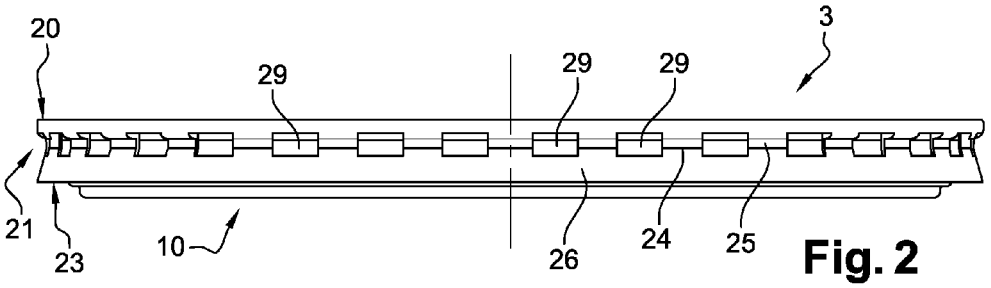
FIG. 2 is a side view of the lid shown FIG. 1.
Figure 3:
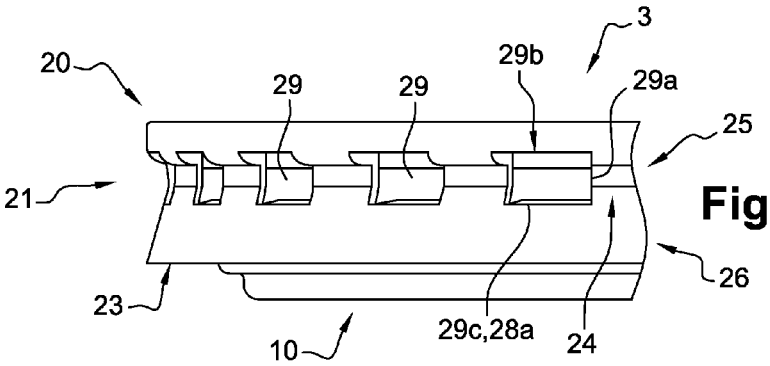
FIG. 3 is an enlarged view of a part of the lid illustrated FIG. 2.
Figure 4:
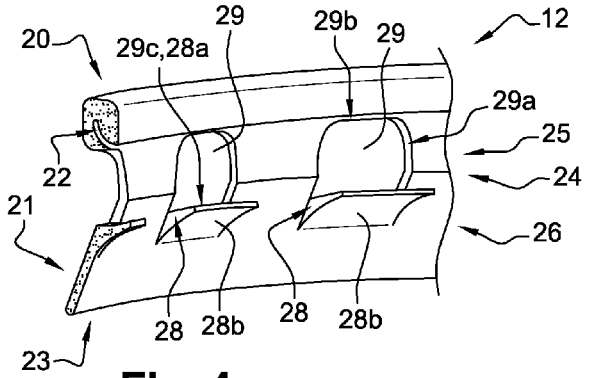
FIG. 4 shows is a partial view of the inner surface of the resilient ring equipping the lid of FIGS. 1 to 3, without its metal cover associated.

As illustrated FIGS. 2 to 4, the resilient ring 12 comprises two main parts:

- a fastening upper part 20, attached to the cover peripheral border 11 and,
- a locking lower part 21, projecting downwardly, at a lower face of the metal cover 10 and facing the upward wall portion 13 of the cover border 11.

As a result, said upward wall portion 13 of the metal cover 10 and said resilient ring 12 define together a downwardly opened cavity or channel, suitable for receiving the sidewall upper edge 6 and its outward projection 8 (as shown FIGS. 6 and 7).

The fastening part 20 of the ring 12 is provided with a channel 22 (shown FIG. 4) wherein the outer part 16 of the cover outward flange 14 is engaged to attach the resilient ring 12 to the metal cover 10.

The locking part 21 of the ring 12 is delimited by a free lower edge 23, and is divided into two annular portions separated by an annular folding line 24, i.e. an upper annular portion 25 and a lower annular portion 26 arranged, respectively, above and bellow said folding line 24. As specified here-after in accordance to FIGS. 6 and 7, the lower portion 26 is foldable around said folding line 24 between two stable positions: a lower locking position and an upper folded unlocking position.

The folding line 24 consists here in a line of reduce thickness, to insure equable folding properties.

In this embodiment, the upper portion 25 of the ring locking part 21 is of cylindrical shape, and the lower portion 26 of said ring locking part 21 is of frustum shape, extending outwardly from the top to the bottom.

The lower portion 26, of frustum shape or cone shape, supports the orientation on the sidewall projection 8 during mostly of industrial filling and during the closing process.

After first opening, this lower portion 26 is advantageously a bit wider, to make it easier the handling of the lid 3 and the closing of the container 1 by hand.

Moreover, this ring locking part 21 is provided with:

- a plurality of beads 28 (two of these beads 28 are seen in FIG. 4), arranged around the inner surface of said lower portion 26 and at a distance from each other, and
- a plurality of orifices 29, arranged around said locking part 21 and also at a distance from each other.

Each said orifices 29 extends at a distance from the ring free lower edge 23. In particular, said orifices 29 each extend through said locking part 21 at its folding line 24, at least over a part of the height of the upper portion 25 and at least over a part of the height of the lower portion 26 thereof.

In this embodiment, the orifices 29 each extend, on the one hand, over the entire height of the upper portion 25 of the ring locking part 21, and on the other hand, over a part of the height of the lower portion 26 of said ring locking part 21.

For instance, each of said orifices 29 extends over 10% to 70% of the height of the lower portion 26.

Each of said orifices 29 comprises a closed or continuous border, here of parallelogram shape (i.e. of rectangular or square type) having two lateral borders 29*a* and two transversal borders, i.e. an upper border 29*b* and a lower border 29*c*.

Moreover, the beads 28 of the lower portion 26 constitute locking means to be engaged below the outward projection 8 of the receiving body 2, so as to lock or to relock the lid 3 onto said receiving body 2 and to retain the cover flange 14 in sealed engagement on the sidewall upper edge 6 (as disclosed here-under in accordance to FIGS. 6 and 7).

As illustrated FIG. 4, said beads 28 are arranged radially, under the folding line 24 and at a distance from each other, into a plan extending at a distance from the ring lower free edge 23; said plan extends perpendicularly to the axis of said ring 12.

In the present embodiment, each bead 28 is of tab shape, comprising (i) an upper face 28*a*, intended to seat under the outward projection 8 of the receiving container 2, and (ii) a lower face 28*b*, suitable to constitute here a ramp-type surface which is able to slide over said outward projection 8.

The upper face 28*a* has here a slope of flat-shape, extending upwardly from the outside to the inside and towards the cover flange 14.

This upper face 28*a* is designed to match in an optimal way the sidewall projection 8, and in particular to rest under its lower end 8*a*".

The lower face 28*b* is of curved shape, extending also upwardly from the outside to the inside and towards the cover flange 14.

As shown also FIG. 4, the orifices 29 and the beads 28 are arranged by couple (or in other words in pairs), i.e. each orifice 29 is arranged directly above one of said beads 28 such as the lower border 29*c* of said orifice 29 corresponds to the upper face 28*a* of the associated bead 28.

Said couples 28, 29 are arranged at a distance from each other, here around the whole circumference of the ring locking part 21.

In the illustrated embodiment, the width of the orifices 29 (i.e. the distance between its two lateral borders 29*a*) is identical, or approximately identical, to that of the beads 28 associated.

The orifices 29 and the beads 28 correspond together to 30% to 80% of the perimeter or the circumference of the ring locking part 21.

The orifices 29 and the beads 28 are here arranged regularly, or at least approximately regularly, around the circumference of the ring locking part 21. The couples of orifices 29/beads 28 are thus detached from each other by a constant, or at least approximately constant, angular sector.

In an alternative embodiment, the couples of orifices 29/beads 28 can be regrouped at some suitable parts of the length of said ring locking part 21.

Figure 5:
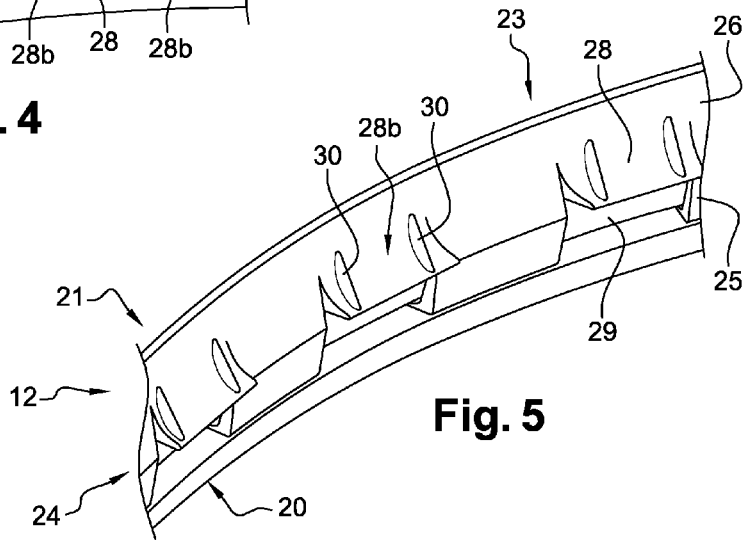
FIG. 5 is a bottom view of another embodiment of the resilient ring suitable to equip the lid of the invention, FIGS. 6 and 7 each show a portion of the container of FIG. 1, the reclosable lid being assembled on the receiving body and the resilient ring being operated in locking position and in unlocking position, respectively.

According to another embodiment shown FIG. 5, the lower face 28*b* of each bead 28 is provided with two lateral ribs 30.

These ribs 30 extend radially, or at least approximately radially, and are arranged at a distance from each other.

The function of these ribs 30 is notably to strengthen the beads 28 associated, and to improve the ramp action of the bead lower face 28*b*.

The ring 12 may be formed separately from the metal cover 6, for example by injection moulding, and the two pieces are then assembled, for instance by press fitting.

Alternatively, the resilient ring 12 may be formed in situ on the metal cover 6 by moulding; such a production process is also called, as aforementioned and hereafter, as "in-mould process".

In such an in situ production process, the beads 28 in the lower portion 26 of the ring 12 are advantageously generated through moulding tool parts which are sliding from outside and in direction of the centre of the tool. These tool parts close the kernel area till the core of the metal cover, and form both the upper surface 28*a* of the beads 28 and the orifices 29.

This in-mould process of the ring 12 is proven in mass-production and in demanded quality producible.

Moreover, a modification of the beads in size, shape and reinforcement is made easier.

In practice, when taking off the lid 3 from the receiving body 2, the lower portion 26 of the ring 12 may be folded/swung upwardly into the unlocking position (as illustrated from FIG. 6 to FIG. 7) and subsequently the lid 3 can be lifted away from the receiving body 2.

The method of fitting/refitting the lid 3 to the receiving body 2 may comprise the conventional method of pressing the lid downwards e. g. by the person using the container.

When fitting/refitting the relockable lid 3, the lower portion 26 of the ring 12 may firstly be swung/folded downwardly into locking position (according to FIGS. 1 to 4) and subsequently the lid 3 is slid downwards until the locking means 28 engage the outward projection 8 of the receiving body 2 (as illustrated from FIG. 6).

In this case, the inner surface of the frustum lower portion 26 and the lower face 28*b* of the beads 28 act as cams, causing an elastic expansion of the ring lower portion 26 when passing at the outward projection 8 and then a final "snap" under said outward projection 8.

This can be done with the standard filling equipment, without any adaptation.

Instead of previously arranging the lower portion 26 of the ring 12 in locking position before fitting the lid 3 to the receiving body 2, the lid 3 may be suitably placed on the opening 7 of the receiving body 2 and only subsequently said lower portion 26 of the ring 12 is swung/folded downwardly into the locking position.

In an alternative embodiment, said couples of beads 28/orifices 29 can be arranged on a resilient ring 12 which is not foldable and does not have said two stable positions (locking position and unlocking position).

The container may contain foodstuff, solvents, chemicals, paints as the lid provides a tight and lockable closure, but the receiving body and the lid may of course also be used for other goods.

Furthermore, the lid is applicable for known containers having a sidewall projection. As the lid can be fitted to such containers by use of conventional production equipment, said lid can be sold separately (not in combination with a receiving body) to manufactures of containers or to manufacturers of consumer goods (e.g. foodstuff, solvents, chemicals, paints).

The invention claimed is:

1. A container comprising:

a metal receiving body having a sidewall provided with a bottom element at a lower end, and a peripheral upper edge at an upper end, the peripheral upper edge delimiting an upper opening and provided with a one-piece outward projection; and a relockable lid comprising a metallic cover configured to close said body upper opening, the cover having a peripheral border is provided with a resilient ring, the resilient ring including a fastening part attached with said cover peripheral border, and a locking part projecting downwardly, the locking part having a lower free edge and being divided into two annular portions separated by an annular folding line, the annular portions including an upper portion arranged above the folding line, and a lower portion arranged below the folding line, the lower portion including an inner surface provided with means for locking configured to lock and to be engaged below said outward projection of the receiving body to lock said lid onto said receiving body, the means for locking including a plurality of beads configured around the inner surface of the lower portion and at a first distance from each other and extending at a second distance from the ring lower free edge, the lower portion being foldable around said folding line between two stable positions that include a locking position and an upper folded unlocking position, the locking part of the resilient ring including a plurality of orifices configured around said locking part at a first distance from each other and extending at a second distance from said ring lower free edge, the orifices extending through the locking part at least over a part of a height of the upper and lower portions.

2. The container according to claim 1, wherein the orifices and the beads are arranged by couples, said orifices being arranged directly above said beads such that a lower border of the orifices corresponds to the upper face of the associated beads, and the couples being arranged at a distance from each other around the ring locking part.

3. The container according to claim 2, wherein the orifices extend over an entire height of the upper portion of the locking part, and over a part of the height of the lower portion of the ring locking part.

4. The container according to claim 2, wherein the upper portion of the locking part is cylindrical, and the lower portion of the locking part has a frustum shape, extending outwardly from the top to the bottom.

5. The container according to claim 2, wherein each bead has a tab shape, having an upper face arranged with an upward slope in a direction of the metallic cover.

6. The container according to claim 1, wherein the orifices extend over an entire height of the upper portion of the locking part, and over a part of a height of the lower portion of the locking part.

7. The container according to claim 1, wherein the upper portion of the locking part is cylindrical, and the lower portion of the locking part has a frustum shape, extending outwardly from the top to the bottom.

8. The container according to claim 1, wherein each bead has a tab shape, having an upper face arranged with an upward slope in a direction of the metallic cover.

9. The container according to claim 8, wherein each bead has a flat upper face, and a curved lower face extending upwardly.

10. The container according to claim 8, wherein the lower face of each bead is provided with at least one rib extending radially, or approximately radially.

11. The container according to claim 10, wherein the lower face of each bead is provided with at least two lateral ribs at a distance from each other and extending radially, or approximately radially.

12. The container according to claim 1, wherein a peripheral border is provided with a flange and an outer part, the flange having an inner part configured to cover the upper peripheral edge of the sidewall body, and the outer part configured to extend outwardly to said upper peripheral edge of the sidewall and to be fastened with said fastening part.

13. The container according to claim 1, wherein the orifices correspond together from 30% to 80% of a circumference of the locking part.

14. The container according to claim 1, wherein the outward projection of the receiving body has a frustum shape oriented downwardly and outwardly in a top to bottom direction of the body sidewall.

15. A relockable lid comprising:

a metallic cover configured to close an upper opening of a receiving body, said cover having a peripheral border provided with a resilient ring, the resilient ring including a fastening part attached with said peripheral border, and a locking part projecting downwardly, the locking part having a lower free edge and being divided into two annular portions separated by an annular folding line, the annular portions including an upper portion arranged above the folding line, and a lower portion arranged below the folding line, the lower portion including an inner surface provided with means for locking configured to lock and to be engaged below an outward projection of the receiving body to lock said lid onto said receiving body, the means for locking including a plurality of beads configured around the inner surface of the lower portion and at a first distance from each other and extending at a second distance from the ring lower free edge, the lower portion being foldable around said folding line between two stable positions that include a locking position and an upper folded unlocking position, the locking part including a plurality of orifices configured around said locking part at a first distance from each other and extending at a second distance from lower free edge, the orifices extending through the locking part at least over a part of a height of the upper and lower portions.

* * * * *